US007594343B2

(12) United States Patent
Woerdehoff et al.

(10) Patent No.: US 7,594,343 B2
(45) Date of Patent: Sep. 29, 2009

(54) DRYING MODE FOR AUTOMATIC CLOTHES DRYER

(75) Inventors: Christopher John Woerdehoff, St. Joseph, MI (US); Andrew Charles Reck, Watervliet, MI (US); David John Kmet, Paw Paw, MI (US); James Frederick Swanson, Berrien Springs, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/353,330

(22) Filed: Feb. 14, 2006

(65) Prior Publication Data

US 2007/0186438 A1 Aug. 16, 2007

(51) Int. Cl.
*F26B 3/00* (2006.01)

(52) U.S. Cl. ..... 34/491; 34/381; 34/572; 34/554; 34/527; 34/562; 68/20; 307/34; 219/497; 392/496; 324/664

(58) Field of Classification Search ..... 34/486, 34/491, 552, 527, 601, 607, 572, 381, 554, 34/562; 68/20; 307/34; 219/497; 392/496; 324/664

See application file for complete search history.

(56) References Cited

U.S. PATENT DOCUMENTS 2,619,736 A * 12/1952 Geldhof ..... 34/131
2,654,160 A * 10/1953 Peterson ..... 34/543
2,717,455 A * 9/1955 Harris et al. ..... 34/543
2,807,889 A * 10/1957 Dunkelman ..... 34/546
2,819,540 A * 1/1958 Toma et al. ..... 34/547
2,820,623 A * 1/1958 Soffer ..... 432/44
2,822,625 A * 2/1958 Olthuis ..... 34/546
2,826,825 A * 3/1958 Morrison ..... 34/543
2,838,845 A * 6/1958 Erickson ..... 34/547
2,851,788 A * 9/1958 Dunkelman ..... 34/547
2,851,789 A * 9/1958 Dunkelman ..... 34/547
2,858,618 A * 11/1958 Kauffman, II ..... 34/546
2,863,224 A * 12/1958 Zehrbach ..... 34/546
2,869,247 A * 1/1959 Metzger ..... 34/547
2,878,579 A * 3/1959 Fuchs ..... 34/546

(Continued)

FOREIGN PATENT DOCUMENTS

EP 0863244 A2 9/1998

OTHER PUBLICATIONS

The documents listed hereinabove were cited in the European Search Report EP 07250563.9 dated Nov. 5, 2007 received in connection with a European Application corresponding to the above-referenced U.S. application.

*Primary Examiner*—Stephen M. Gravini
(74) *Attorney, Agent, or Firm*—Clifton G. Green; McGarry Bair P.C.

(57) ABSTRACT

A method of drying clothes in a clothes dryer comprising a clothes chamber for receiving clothes, an air supply system for directing air through the clothes chamber, and a heater for heating the air supplied by the air supply system. The method comprises cycling the heater between an ON state by energizing the heater until a heater trip condition is met and an OFF state by deenergizing the heater until a heater reset condition is met, determining a heater off time by determining the time between the heater trip condition and the heater reset condition, and determining a drying time based on the heater off time.

22 Claims, 9 Drawing Sheets

U.S. PATENT DOCUMENTS 2,882,610 A * 4/1959 Hughes ..... 34/546
2,885,789 A * 5/1959 Conkling et al. ..... 34/547
2,887,785 A * 5/1959 Raley ..... 34/527
2,892,334 A * 6/1959 Gray, Jr. ..... 68/12.15
2,904,895 A * 9/1959 Bochan ..... 34/527
2,919,493 A * 1/1960 Candor ..... 34/549
2,983,129 A * 5/1961 Metzger ..... 68/12.14
3,018,560 A * 1/1962 Morey ..... 34/527
3,028,680 A * 4/1962 Conlee et al. ..... 34/145
3,032,888 A * 5/1962 Algino ..... 34/527
3,037,296 A * 6/1962 Raney et al. ..... 34/527
3,059,344 A * 10/1962 Conlee ..... 34/527
3,071,864 A * 1/1963 Menk ..... 34/527
3,088,221 A * 5/1963 Pansing et al. ..... 34/527
3,109,717 A * 11/1963 Clapp ..... 34/527
3,122,426 A * 2/1964 Horecky ..... 34/531
3,159,465 A * 12/1964 Morey ..... 34/527
3,161,481 A * 12/1964 Edwards ..... 34/527
3,169,838 A * 2/1965 Kripke ..... 34/528
3,186,104 A * 6/1965 Stilwell, Jr. ..... 34/527
3,210,862 A * 10/1965 Lycan ..... 34/527
3,213,548 A * 10/1965 Deaton ..... 34/527
3,216,126 A * 11/1965 Brucken et al. ..... 34/527
3,217,422 A * 11/1965 Fuqua et al. ..... 34/527
3,220,117 A * 11/1965 Lycan ..... 34/527
3,223,395 A * 12/1965 Genbauffe ..... 432/44
3,229,379 A * 1/1966 Heidtmann ..... 34/533
3,229,380 A * 1/1966 Worst ..... 34/533
3,253,347 A * 5/1966 Kripke ..... 34/546
3,273,256 A * 9/1966 Behrens ..... 34/546
3,318,015 A * 5/1967 Metzger ..... 34/528
3,330,047 A * 7/1967 Rodgers ..... 34/532
3,335,501 A * 8/1967 Janke et al. ..... 34/528
3,364,585 A * 1/1968 Fish et al. ..... 34/527
3,381,389 A * 5/1968 Kurowski ..... 34/527
3,394,466 A * 7/1968 Heidtmann ..... 34/528
3,397,461 A * 8/1968 Fogt et al. ..... 34/527
3,398,460 A * 8/1968 Elders ..... 34/533
3,398,462 A * 8/1968 Harter ..... 34/527
3,404,466 A * 10/1968 Reid ..... 34/533
3,471,937 A * 10/1969 Genbauffe ..... 34/527
3,475,830 A * 11/1969 Botts et al. ..... 34/533
3,491,458 A * 1/1970 Elders et al. ..... 34/533
3,497,964 A * 3/1970 Elders ..... 34/533
3,508,340 A * 4/1970 Kombol ..... 34/553
3,540,131 A * 11/1970 Kahale ..... 34/532
3,545,096 A * 12/1970 Robandt et al. ..... 34/547
3,613,254 A * 10/1971 Smith ..... 34/527
3,621,293 A * 11/1971 Heidtmann ..... 327/428
3,651,579 A * 3/1972 Smith ..... 34/532
3,733,712 A * 5/1973 Smith ..... 34/532
3,762,064 A 10/1973 Offutt ..... 34/45
3,864,844 A * 2/1975 Heidtmann ..... 34/528
3,942,265 A * 3/1976 Sisler et al. ..... 34/527
4,019,259 A * 4/1977 Veraart ..... 34/550
4,083,118 A 4/1978 Cotton ..... 34/53
4,275,508 A * 6/1981 Jones ..... 34/524
4,546,554 A * 10/1985 Bullock et al. ..... 34/554
4,622,759 A 11/1986 Abe et al.
4,649,654 A * 3/1987 Hikino et al. ..... 34/493
4,733,479 A * 3/1988 Kaji et al. ..... 34/446
4,738,034 A * 4/1988 Muramatsu et al. ..... 34/524
4,763,425 A 8/1988 Grennan ..... 34/48
4,827,627 A 5/1989 Cardoso
4,991,313 A 2/1991 Joslin
5,101,575 A * 4/1992 Bashark ..... 34/562
5,193,292 A 3/1993 Hart et al. ..... 34/30
5,345,694 A * 9/1994 Hayashi ..... 34/550
5,443,541 A * 8/1995 St. Louis ..... 34/486
5,673,497 A * 10/1997 St. Louis ..... 34/486
5,782,012 A * 7/1998 Sanders et al. ..... 34/527
6,047,486 A * 4/2000 Reck et al. ..... 34/491
6,446,357 B2 * 9/2002 Woerdehoff et al. ..... 34/491
6,493,963 B1 * 12/2002 England ..... 34/491
6,845,290 B1 * 1/2005 Wunderlin et al. ..... 700/208
6,968,632 B2 * 11/2005 Guinibert et al. ..... 34/602
7,065,905 B2 * 6/2006 Guinibert et al. ..... 34/603
7,117,613 B2 * 10/2006 Guinibert et al. ..... 34/534
7,257,905 B2 * 8/2007 Guinibert et al. ..... 34/82
7,412,783 B2 * 8/2008 Guinibert et al. ..... 34/572
7,478,486 B2 * 1/2009 Wunderlin et al. ..... 34/491
2006/0191161 A1 * 8/2006 Wunderlin et al. ..... 34/562
2009/0100702 A1 * 4/2009 Fair ..... 34/487

* cited by examiner

Dryer Configuration A Mode 1 Heater Off Time Values

| DRYNESS LEVEL | CYCLE | | | | |
|---|---|---|---|---|---|
| | Heavy Duty | Jeans | Normal | Casual | Delicate |
| **ELECTRIC** | | | | | |
| **More** | 5 | 6 | 5 | 7 | 8 |
| More Normal | — | — | — | — | — |
| **Normal** | 4 | 5 | 4 | 6 | 7 |
| Less Normal | — | — | — | — | — |
| **Less** | 3 | 4 | 3 | 5 | 6 |

Fig. 4A

Dryer Configuration B Mode 1 Heater Off Time Values

| DRYNESS LEVEL | CYCLE | | | | | |
|---|---|---|---|---|---|---|
| | Heavy Duty | Normal | Casual | Delicate | Super Del. | Damp Dry |
| **ELECTRIC** | | | | | | |
| **More** | 5 | 5 | 7 | 5 | 8 | 4 |
| More Normal | — | — | — | — | — | — |
| **Normal** | 4 | 4 | 6 | 4 | 7 | 3 |
| Less Normal | — | — | — | — | — | — |
| **Less** | 3 | 3 | 5 | 3 | 6 | 2 |

Fig. 4B

Dryer Configuration A Mode 2 Heater Off Time Values

| DRYNESS LEVEL | CYCLE | | | | |
|---|---|---|---|---|---|
| | Heavy Duty | Jeans | Normal | Casual | Delicate |
| ELECTRIC | | | | | |
| More | 7 | 9 | 7 | 9 | 8 |
| More Normal | — | — | — | — | — |
| Normal | 6 | 8 | 6 | 8 | 7 |
| Less Normal | — | — | — | — | — |
| Less | 5 | 7 | 5 | 7 | 6 |

Fig. 5A

Dryer Configuration B Mode 2 Heater Off Time Values

| DRYNESS LEVEL | CYCLE | | | | | |
|---|---|---|---|---|---|---|
| | Heavy Duty | Normal | Casual | Delicate | Super Del. | Damp Dry |
| ELECTRIC | | | | | | |
| More | 7 | 7 | 9 | 6 | 8 | 6 |
| More Normal | — | — | — | — | — | — |
| Normal | 6 | 6 | 8 | 5 | 7 | 5 |
| Less Normal | — | — | — | — | — | — |
| Less | 5 | 5 | 7 | 4 | 6 | 4 |

Fig. 5B

DRYING MODE FOR AUTOMATIC CLOTHES DRYER

BACKGROUND OF THE INVENTION

1. Field of the Invention

The invention relates generally to automatic clothes dryers, and, more particularly the invention relates to a method of determining a drying time for an automatic clothes dryer.

2. Description of the Related Art

Automatic clothes dryers are well known, and typically comprise a cabinet enclosing a horizontally rotating drum accessible through an access door at the front of the cabinet for holding clothing items to be dried. A heater positioned in an air inlet assembly upstream of the drum is utilized for heating the drying air prior to its entry into the drum. The drying air is delivered to the drum through a motor-driven blower assembly. A temperature sensor is utilized in an air outlet assembly downstream of the drum for monitoring the temperature of the exhausted air and determining when drying is complete.

During the drying cycle, the heater is sequentially energized and deenergized to increase and decrease the temperature of the air entering the drum. The heater is energized until the temperature of the air reaches a preselected limit temperature, at which time the heater is deenergized. The temperature of the air is allowed to decrease until a preselected reset temperature is reached, at which time the heater is reenergized. The cycle is repeated until the clothes reach a preselected dryness state, at which time the heater is deenergized and a cool down period occurs, during which the drum continues to rotate with unheated air flowing therethrough.

In a mechanical-timer-based dryer, the duration of the drying cycle is set by simply selecting a time duration, or by selecting a combination of clothes load characteristics (e.g. bulky items, woolens, normal, etc.) and a desired degree of dryness to be achieved at the end of the cycle. With either method, a mechanical timer is set and advances only during those time periods when the heater is deenergized, until the time expires.

A typical automatic clothes dryer also incorporates a moisture sensor in the drum, which consists of a pair of electrical contacts in close proximity to each other which are exposed to impacts by the clothes in the drum as the drum is rotated. When a wet article of clothing "bridges" across the sensor contacts, a circuit is closed, and this circuit closure is recorded in the dryer's control module. Circuit closures are accumulated over a preselected period of time and processed in the control module to arrive at a resulting number of "wet hits." The wet hits are used as a measure of the size of the clothes load in the drum. The number of wet hits can be used to adjust the duration of the drying cycle. A common way to do this is to determine an "Add On" dry time that is determined by the remaining moisture content of the load and drying cycle parameters selected by the user. This methodology is described in U.S. Pat. No. 6,446,357 to Woerdehoff, et al., which is incorporated herein by reference.

If the number of wet hits is below a preselected value, this can indicate several conditions: the clothes load is small or the drum is empty, the moisture sensor is not operating properly, or the clothes load is relatively dry to begin with. In each case, it would be preferable to adjust the drying time during the drying cycle to accommodate such conditions. However, conventional dryers will continue to operate through a preselected cycle without modification based upon the predetermined drying time, which can result in overheating of the clothes, with accompanying excessive shrinkage or damage, excess energy usage, and increased wear on the dryer components.

SUMMARY OF THE INVENTION

A method of drying clothes in a clothes dryer comprising a clothes chamber for receiving clothes, an air supply system for directing air through the clothes chamber, and a heater for heating the air supplied by the air supply system. The method comprises cycling the heater between an ON state by energizing the heater until a heater trip condition is met and an OFF state by deenergizing the heater until a heater reset condition is met, determining a heater off time by determining the time between the heater trip condition and the heater reset condition, and determining a drying time based on the heater off time.

BRIEF DESCRIPTION OF THE DRAWINGS

In the drawings:

FIG. 4A is a table of exemplary drying cycle time values for a first dryer configuration and a first drying mode for preselected dryness values and fabric types.

FIG. 4B is a table of exemplary drying cycle time values for a first dryer configuration and a second drying mode for preselected dryness values and fabric types.

FIG. 5A is a table of exemplary drying cycle time values for a second dryer configuration and a first drying mode for preselected dryness values and fabric types.

FIG. 5B is a table of exemplary drying cycle time values for a second dryer configuration and a second drying mode for preselected dryness values and fabric types.

DESCRIPTION OF AN EMBODIMENT OF THE INVENTION

Figure 1:
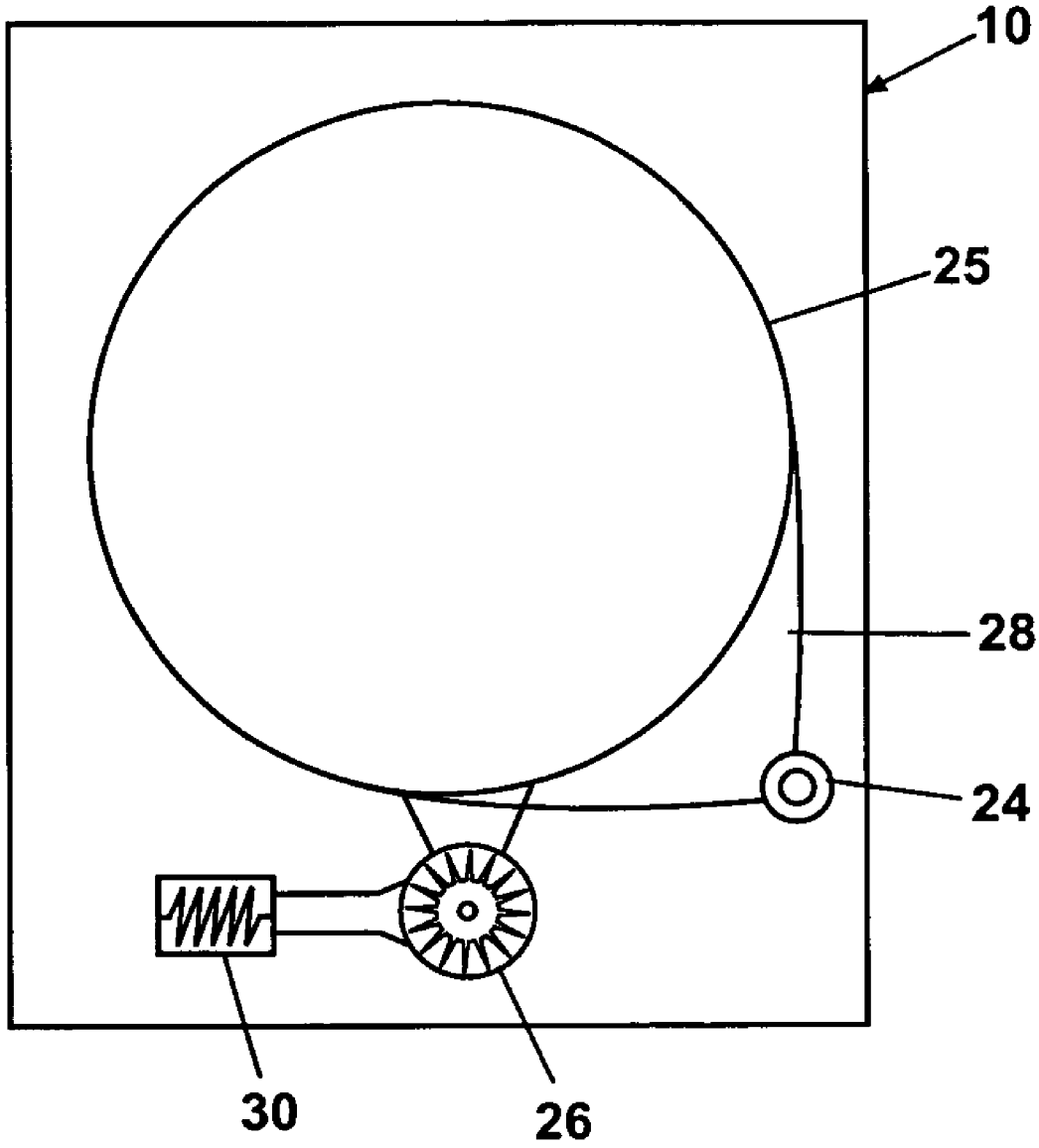
FIG. 1 is a schematic representation of one embodiment of an automatic clothes drier according to the invention.
Figure 1A:
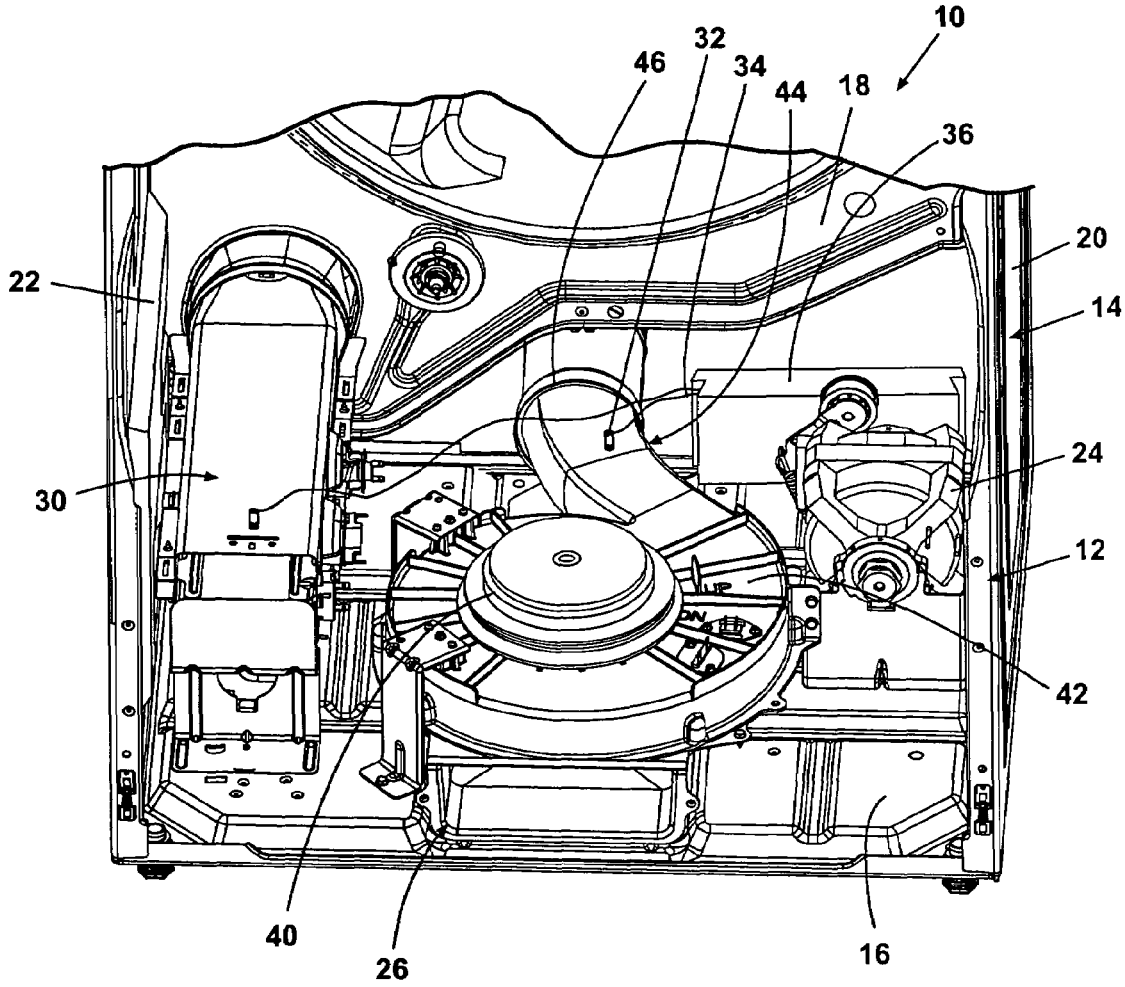
FIG. 1A is a perspective partial cutaway view of the embodiment of the automatic clothes dryer illustrated in FIG. 1.

Referring now to the Figures, and to FIG. 1A in particular, an automatic clothes dryer 10 illustrating one embodiment of the invention is shown comprising a cabinet 14, a rotating drum 25 for holding items to be dried, a motor for rotating the drum 25, and an endless drive belt 28 coupling the drum 25 with the motor 24. These elements are generally well-known and will not be described further herein except as necessary for a complete understanding of the invention. A lower portion of the interior of the dryer 10 is illustrated in a partially cut-away view in FIG. 1A to show the internal structure and components of the dryer 10. A support frame 12 is enclosed by the cabinet 14 in a well-known configuration. The cabinet 14 comprises a floor 16, a back wall 18, and side walls 20, 22. The cabinet 14 also comprises a front wall, which is not shown in the Figures. The cabinet 14 encloses the motor 24 and a blower assembly 26. The motor 24 rotates the drum 25, which is adapted to hold a load of clothes or other fabric items for drying, through the endless drive belt 28.

The cabinet 14 also encloses a heater assembly 30 which is fluidly connected to the drum at an upstream location and into which air is drawn and heated prior to delivery to the drum. The blower assembly 26 comprises a blower motor 40 which drives a blower impeller 42 which is fluidly connected to the drum at a downstream location and which draws air from the heater assembly 30 through the drum and out of the dryer 10 through a blower outlet 44 fluidly connected to an outlet duct 46. A temperature sensor 32, such as a thermistor, is incorporated into the blower outlet 44 for monitoring of the temperature of the air exiting the drum, which is connected to electrical leads 34 to a dryer control module 36. The control module 36 incorporates a microprocessor or controller (not shown) which is capable of receiving and processing signals from the temperature sensor 32 for controlling the operation of the dryer 10, such as the duration of a drying cycle, according to preprogrammed instructions and/or algorithms, some of which may be determined by user-selected inputs.

Figure 2:
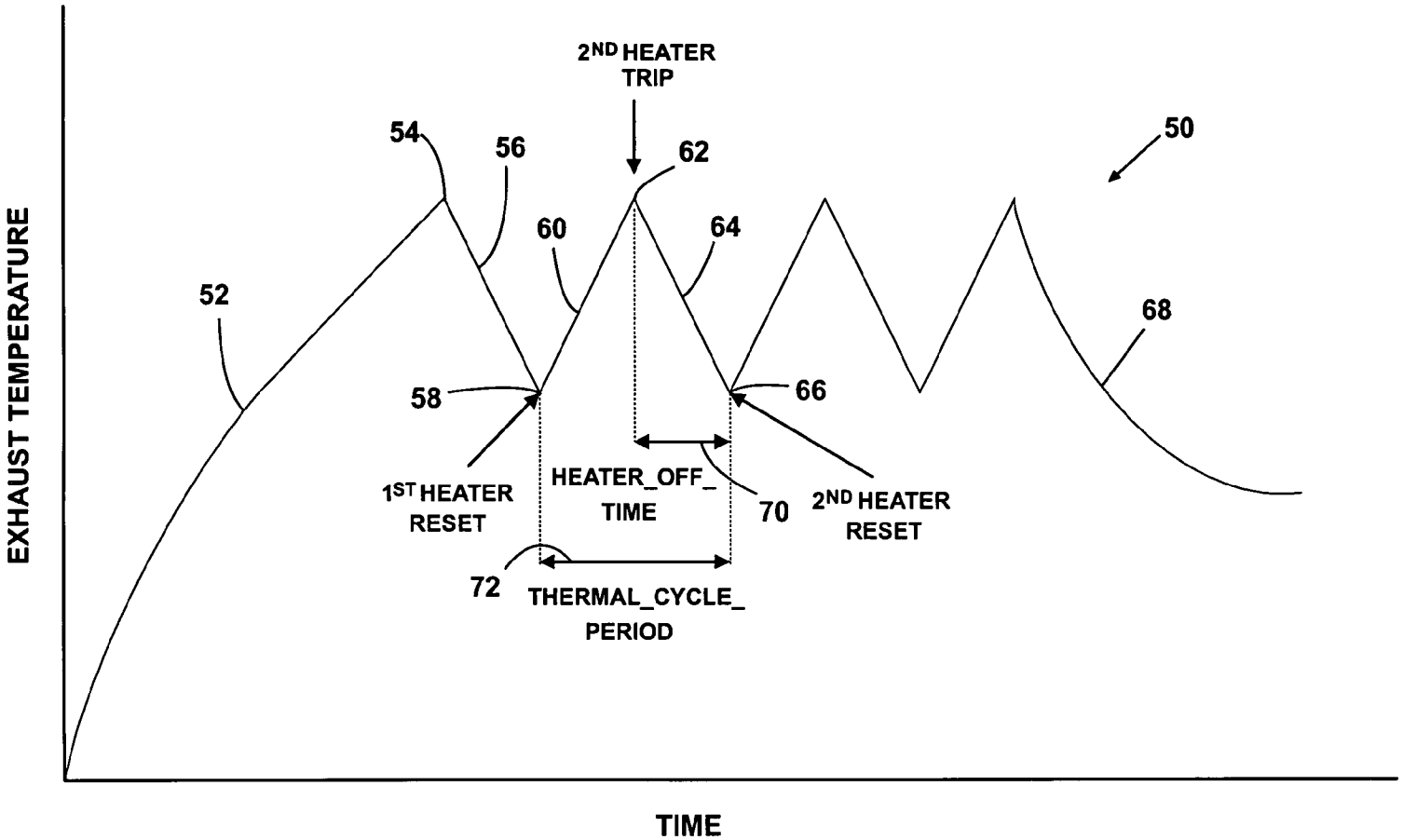
FIG. 2 is a graphical representation of exhaust temperature versus time for an exemplary drying cycle for the automatic clothes dryer of FIG. 1.

FIG. 2 illustrates a temperature curve 50 representing a variation in temperature over time as determined by the temperature sensor 32 during a drying cycle. To summarize, the drying cycle is initiated by rotating the drum while energizing the heater assembly 30 until the temperature of the air flowing through the dryer 10 determined by the temperature sensor 32 reaches a preselected value, referred to as an upper limit trip point. When the upper limit trip point is reached, the heater assembly 30 is deenergized, thereby enabling air flowing through the dryer 10 to cool to a preselected value, referred to as a lower limit reset point. When the lower limit reset point is reached, the heater assembly 30 is again energized until the temperature of the air reaches the upper limit trip point, and the process is repeated until the end of the drying cycle is reached.

The end of the drying cycle can be determined in one of several ways. For example, the user can select a time duration for the drying cycle, such as by inputting a desired time through a digital input device or a mechanical timer. Alternatively, an algorithm can be programmed into the control module 36 to select an appropriate time based upon user inputs relating to the type of clothes load in the dryer, a desired degree of dryness, a drum rotation speed, and the like. The "time" value selected by the controller is the total cycle time independent of heater on time or time of day. The former is common with more electronic controllers and the latter is more common with mechanical controllers. Time is then decremented accordingly.

The invention described and claimed herein utilizes information concerning the heater assembly deenergized conditions to determine an optimum drying time for selected conditions of load size, clothes load type, and desired degree of dryness.

As illustrated in FIG. 2, the drying cycle comprises an initial temperature rise 52 as a result of the energizing of the heater assembly 30 and the initial heating of the air flowing through the drum. After an elapsed time, which will depend upon the size and moisture content of the clothes load, an upper limit trip point 54 will be reached. The heater assembly 30 will be deenergized, resulting in a temperature decrease 56 until a lower limit reset point 58 is reached. The heater assembly 30 will be reenergized, resulting in a temperature rise 60 until the upper limit trip point 62 is again reached. The deenergizing of the heater assembly 30 will result in a temperature decrease 64 until the lower limit reset point 66 is again reached. This continues until the termination of energizing and deenergizing of the heater assembly 30, which is followed by a cool down period 68. The time between the first lower limit reset point 58 and the second lower limit reset point 66 is termed the thermal cycle period 72. The time between the upper limit trip point 62 and the lower limit reset point 66 is termed the heater off time 70. The heater off time 70 is equal to the duration of the second temperature decrease 64. The time associated with each of these points is recorded in the control module 36. It is worth noting that only four upper limit trips are illustrated in FIG. 2, but that the actual drying cycle can have any number of upper limit trips and lower limit resets.

Figure 3:
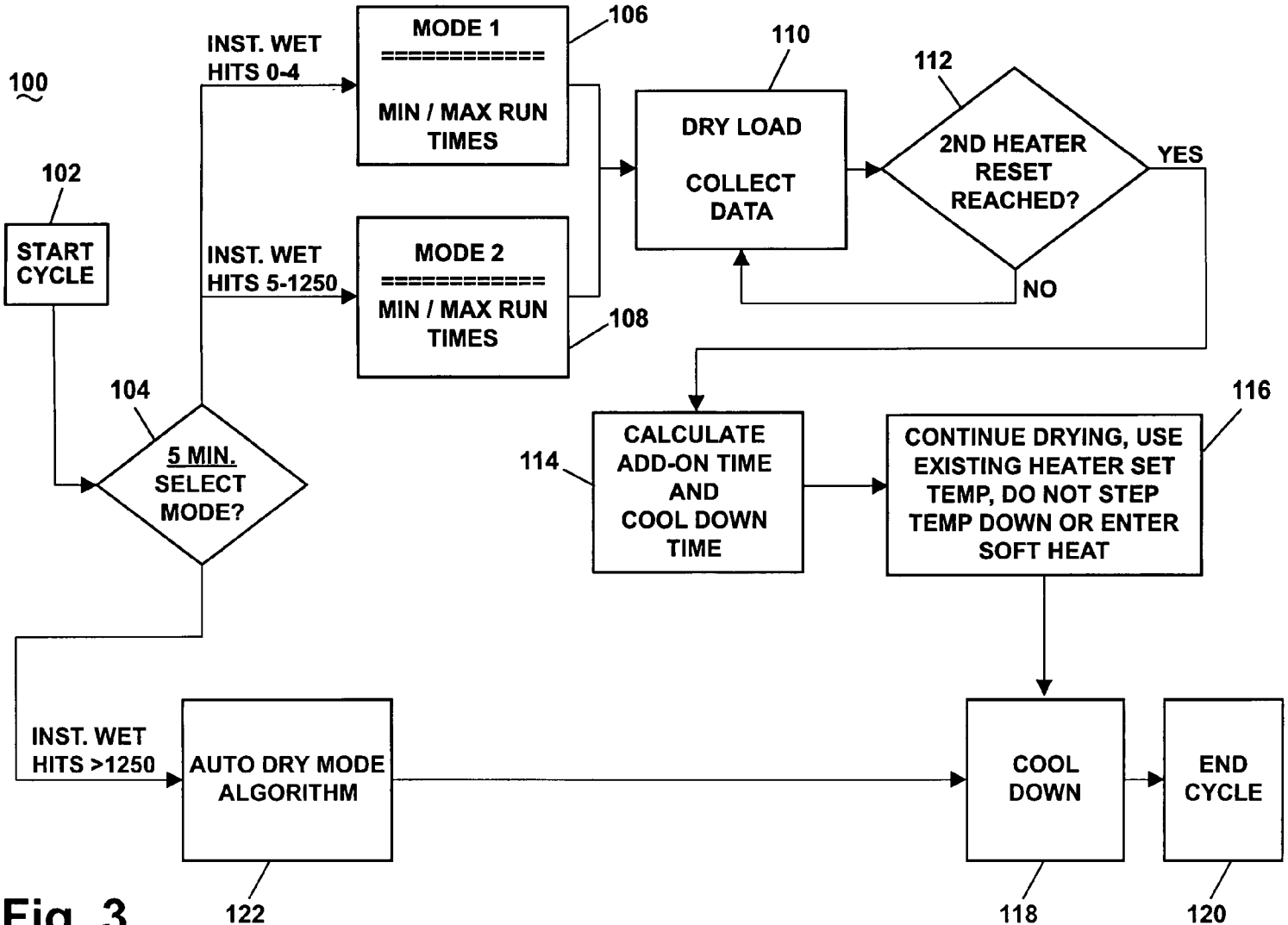
FIG. 3 is a flow chart illustrating drying cycles for the automatic clothes dryer of FIG. 1 for differing sizes and moisture contents of dryer loads based upon wet hit values.

FIG. 3 illustrates a drying mode flow diagram 100 which shows the various steps for three different drying modes for the clothes dryer 10. The first step comprises the initiation of the drying cycle 102, such as a user activating a switch or button on a control panel to start the clothes dryer 10. The drum is rotated for five minutes, during which time the number of instantaneous wet hits as detected by a moisture sensor (not shown) is recorded. Based upon the number of wet hits, a mode of operation is selected 104. If the number of instantaneous wet hits is 0 to 4, the dryer is operated in a mode which will be referred to hereinafter as "Mode 1." If the number of instantaneous wet hits is 5 to 1250, the dryer is operated in a mode which will be referred to hereinafter as "Mode 2." If the number of instantaneous wet hits is greater than 1250, the dryer is operated in a mode which is referred to hereinafter as "Auto Dry Mode."

Mode 1 represents a condition when little or no moisture is detected, which can be the result of an empty drum, a small load, or the moisture sensor not operating properly. Mode 2 represents a condition when a clothes load is not large or wet enough for the Auto Dry Mode. Auto Dry Mode is used for clothes loads that are large and relatively wet. Auto Dry Mode uses the moisture sensor to detect the surface conductivity of the clothes and derive the moisture content of the load from the conductivity measurement. The total time of a cycle using Auto Dry Mode is determined from an algorithm, and is dependent upon the load size, load type, and moisture content.

If Mode 1 is selected, minimum and maximum run times are selected 106. These minimum and maximum run times take precedence over the times that are calculated as described hereinafter. For example the minimum drying time in Mode 1 may be 10 minutes, plus a cool down time. The maximum drying time in Mode 1 may be 25 minutes, plus a cool down time. If the calculated time is less than 10 minutes, the drying cycle will continue for a minimum of 10 minutes, followed by the cool down time.

If Mode 2 is selected, minimum and maximum run times are selected 108. Examples of minimum and maximum run times for Mode 2 are 10 minutes and 45 minutes, respectively, plus cool down times.

After the minimum and maximum run times are selected, the drying cycle is initiated 110, during which time data is accumulated in the control module 36 from the temperature sensor 32 regarding upper limit trip points and lower limit reset points. Whether the lower limit reset point 66 has been reached is evaluated 112. If it has not, drying continues 110, with reevaluation of whether the lower limit reset point 66 has been reached. When the lower limit reset point 66 has been reached, the add-on time is calculated 114 and the drying cycle is continued at 116 until the add-on time is completed. Cool down is performed 118 and the cycle ends 120. The cool down time can be determined in a preselected manner, for example by using a "lookup table" or an array of cool down times stored in the control module 30 and based upon selected fabric type, dryness, load size, and the like, or by calculating the cool down time based upon a total calculated dry time and a preselected heater set temperature.

If Auto Dry Mode is selected, the Auto Dry Mode algorithm is implemented 122 to set a drying time which is completed, followed by a cool down period 118 during which no heat is added until the cycle ends 120. The Auto Dry Mode is currently used in the marketplace, and is not germane to the invention described and claimed herein.

For Modes 1 and 2, an add-on time is calculated and added to the time corresponding with the lower limit reset point 66 to establish the total dry time of the drying cycle. The equations for the calculation of the add-on dry time are as follows:

$$\text{TimeCalc}_1=\text{Heater Off Time Value}/\text{Heater Off Time}, \quad a)$$

$$\text{TimeCalc}_2=\text{TimeCalc}_1\times\text{Thermal Cycle Period}, \quad b)$$

$$\text{Add On Dry Time}=\text{TimeCalc}_2-\text{Fab Master Time}, \quad c)$$

where:

Heater Off Time Value=preestablished value based upon dryer configuration, clothes load, degree of dryness, units of time;

Heater Off Time=the difference between the lower limit reset point and the prior upper limit trip point, e.g. the difference between points 66 and 62 of FIG. 2, units of time;

Thermal Cycle Period=the difference between the lower limit reset point and a prior lower limit reset point, e.g. the difference between points 66 and 58 of FIG. 2, units of time, Fab Master Time=(lower limit reset point 58−upper limit trip point 54)+(lower limit reset point 66−upper limit trip point 62) or a minimum threshold time, such as 5 minutes, whichever is greater, units of time.

The units of time can be in any convenient units depending on the means employed to track the time and the degree of accuracy desired. For example, time can be in milliseconds, seconds, or minutes. It is anticipated that Heater Off Time and Thermal Cycle Period will be in seconds, and that Heater Off Time Value and Add On Dry Time will be in minutes. Thus, appropriate conversion factors must be used to ensure consistency of time units throughout the above calculations.

While FIG. 2, illustrates the Heater Off Time being determined between the second heater reset and the second heater trip, it is within the scope of the invention for any heater resets and heater trips to be used. The same is true for the determination of the Thermal Cycle Period and the Fab Master Time.

The Heater Off Time Value is selected from data stored in the control module 36 for both Mode 1 and Mode 2. An example of such data, expressed in units of minutes, is set out in tabular form in FIGS. 4A and 4B. FIG. 4A represents a first dryer configuration "A" incorporating electric heating, and operating in Mode 1. Dryer A provides a choice of five drying cycles: Heavy-Duty, Jeans, Normal, Casual, and Delicate. Additionally, Dryer A provides a choice of dryness levels ranging from "More" to "Normal" to "Less." Each combination of drying cycle and dryness level corresponds to a Heater off Time Value. For example, for an electric dryer operated at a casual cycle and a normal dryness level, the Heater Off Time Value is 6 minutes. Similar data can also be stored in the control module 36 related to a dryer incorporating gas heating.

The Add On Dry Time is added to the time corresponding to the lower limit reset point 66, but only for the heater off times. In other words, the Add On Dry Time represents the total of the heater off times during the continuation of the heater energized/deenergized cycles after the lower limit reset point 66.

FIG. 4B represents a second dryer configuration "B" incorporating electric heating, likewise operating in Mode 1. Dryer B provides a choice of six drying cycles: Heavy-Duty, Normal, Casual, Delicate, Super Delicate, and Damp Dry. Additionally, Dryer B provides a choice of dryness levels ranging from "More" to "Normal" to "Less." As with FIG. 4A, each combination of drying cycle and dryness level corresponds to a Heater Off Time Value, in minutes. Similar data can also be stored in the control module 36 related to a dryer incorporating gas heating.

The Heater Off Time Values are empirically derived and are specific to a particular dryer configuration, such as drum size, cycle selections, gas or electric heat, air flow characteristics, and the like. Each different dryer will have Heater Off Time Value data unique to its configuration.

FIGS. 5A and 5B are analogous to FIGS. 4A and 4B, and represent dryer configurations "A" and "B," respectively, operating in Mode 2. Each dryer configuration will, thus, have Heater Off Time Value data for both Mode 1 and Mode 2.

The following example illustrates how the drying cycle is determined. It is assumed for purposes of this example that the dryer has Dryer Configuration "A," operates with electric heat, and that 875 instantaneous wet hits have been recorded during the first 5 minutes of operation. It is also assumed that the user selects the Casual cycle, and a Normal dryness level.

Based upon the 875 instantaneous wet hits, the control module 36 selects Mode 2 for operation. The applicable Heater Off Time Value data is set out in FIG. 5A. The Heater Off Time Value is 8 minutes, or 480 seconds.

Referring again to FIG. 2, based upon the assumption that the Heater Off Time 70 is 162 seconds, the $\text{TimeCalc}_1$ value is 480/162=2.963. Assuming that the Thermal Cycle Period is 344 seconds, the $\text{TimeCalc}_2$ value is 2.963*344=1,019 seconds, or 17 minutes.

Assuming that the difference in time between the lower limit reset point 58 and the upper limit trip point 54 is 180 seconds, or 3 minutes, and that the difference in time between the lower limit reset point 66 and the upper limit trip point 62 (which is the Heater Off Time 70) is 162/60=2.7 minutes, the total of these two values is 5.7 minutes. Thus, the Add On Dry Time equals 17−5.7 (the greater of 5.7 minutes and 5 minutes) =11.3 minutes. This time is the remaining cycle time beginning with the $2^{nd}$ Heater Reset time.

Figure 6:
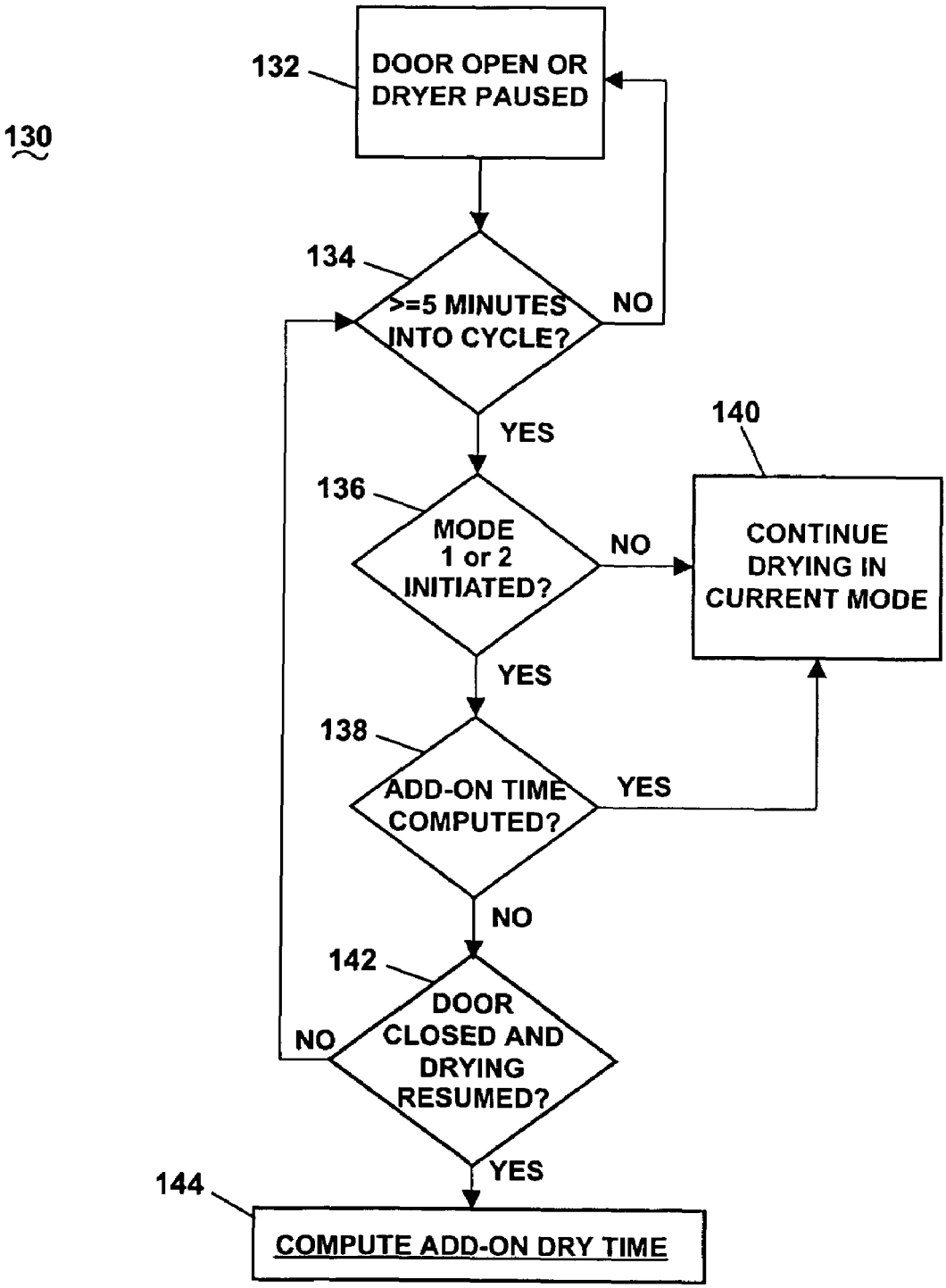
FIG. 6 is a flow chart illustrating a drying cycle supplemental routine for use when a dryer door is opened or the drying cycle is paused.

Referring now to FIG. 6, there may be occasions when the drying cycle is interrupted, such as when the door is opened to add an article or check the dryness of the load. In such cases, the dryer pause flow diagram 130 of FIG. 6 illustrates the calculation of an add-on dry time. The routine 130 is initiated by the opening of the dryer door or other drying cycle pause condition 132. At a time expiration determination step 134, the routine 130 evaluates whether the time since the initiation of the cycle is greater than or equal to five minutes. If not, the time expiration determination step 134 is repeated until a "yes" answer results. The routine then evaluates at a mode determination step 136 whether either mode 1 or mode 2 has been initiated. A "no" answer means that the dryer is operating in Auto Dry Mode as a result of there having been more than 1250 wet hits at the initiation of the drying cycle (FIG. 3). If the answer is "yes," then whether an add-on time has previously been calculated is evaluated at an add-on time determination step 138.

If an add-on time has been calculated, then drying is continued in the current mode 140. If, however, an add-on time has not been calculated, then the routine proceeds to a drying resumption step 142, which evaluates whether the dryer door is closed and drying has resumed. A "no" answer returns the routine to the time expiration determination step 134 where the above-described evaluation steps are repeated. If the door has been closed and drying has resumed, an add-on time is calculated 144 which accounts for the pausing of the dryer. This "revised" add-on time is necessary because the "heater off" data used for the standard calculation is invalid due to the passage of time while the dryer is paused. It will be recognized from step 138 that, if the routine has progressed to the add-on time calculation step 144, the add-on time will not have been calculated.

The add-on dry time is calculated from the following equation:

Add On Dry Time=Heater Off Time Value×2−Cool Down Time, where:

Heater Off Time Value=preestablished value based upon dryer configuration, clothes load, degree of dryness, units of time, as illustrated in FIGS. 4A-5B, and Cool Down Time=a cool down time determined as previously described herein. The Add on Dry Time is then added to the time already elapsed since the beginning of the drying cycle for completion of the drying cycle.

The dryer configuration and operation described herein enable accurate and efficient drying of small loads and avoids the problems in the prior art with small loads being under dry at the end of the drying cycle. The dryer is operated to accommodate small drying loads which register fewer than a threshold number of wet hits, or to accommodate a situation wherein the moisture sensing circuitry is not functioning properly. Heater off time is utilized as the primary input to an empirically-based calculation of drying time. The determination of an optimal drying time is based upon real information about the size of the clothes load and its moisture content, and results in optimal drying with an optimal use of energy.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of drying clothes in a clothes dryer comprising a clothes chamber for receiving clothes, an air supply system for directing air through the clothes chamber, and a heater for heating the air supplied by the air supply system, the method comprising:

energizing the heater between a lower limit trip point temperature and an upper limit trip point temperature, which is higher than the lower limit trip point temperature, to define an ON state, with the lower limit trip point temperature defining a heater reset condition and the upper limit trip point temperature defining a heater trip condition;

deenergizing the heater between the upper limit trip point temperature and the lower limit trip point temperature to define an OFF state;

cycling the heater between the ON state and the OFF state to supply heat to the clothes chamber;

determining a heater off time corresponding to the duration of the heater in the OFF state by determining the time between the heater trip condition and the heater reset condition; and calculating a drying time based on the heater off time.

2. The method according to claim 1, wherein the calculating of the drying time comprises calculating an ADD ON drying time based on the heater OFF time.

3. The method according to claim 1, wherein the calculating of the drying time based on the heater OFF time is only done in the absence of meaningful moisture data regarding the clothes.

4. The method according to claim 3, wherein meaningful moisture data is determined by the number of wet hits generated by a moisture sensor in the clothes chamber.

5. The method according to claim 1, wherein the calculating of the drying time comprises comparing the heater OFF time to a predetermined heater OFF time.

6. The method according to claim 5, wherein the predetermined heater OFF time is representative of a user-selected drying cycle parameter.

7. The method according to claim 5, wherein the comparing of the heater OFF time to the predetermined heater OFF time comprises determining a ratio of the predetermined heater OFF time to the heater OFF time.

8. The method according to claim 7, wherein the calculating of the drying time comprises determining a thermal cycle period and then calculating a product of the ratio and the thermal cycle period.

9. The method according to claim 8, wherein the determining of the thermal cycle period comprises determining the lapse of time between sequential heater trip conditions or heater reset conditions.

10. The method according to claim 8, wherein the determining of the heater OFF time is determined at the second cycle of the heater from the heater trip condition to the heater reset condition.

11. The method according to claim 10, wherein the calculating of the drying time comprises determining an accumulated heater OFF time representing the time that the heater is in the OFF state prior to the second cycle and subtracting the accumulated heater OFF time from the product.

12. A method of drying clothes in a clothes dryer comprising a clothes chamber for receiving clothes, an air supply system for directing air through the clothes chamber, and a heater for heating the air supplied by the air supply system, the method comprising:

energizing the heater between a lower limit trip point temperature and an upper limit trip point temperature, which is higher than the lower limit trip point temperature, to define an ON state, with the lower limit trip point temperature defining a heater reset condition and the upper limit trip point temperature defining a heater trip condition;

deenergizing the heater between the upper limit trip point temperature and the lower limit trip point temperature to define an OFF state;

cycling the heater between the ON state and the OFF state to supply heat to the clothes chamber;

determining a heater off time by determining the duration of the heater in the OFF state;

calculating an ADD ON drying time based on the heater off time; and operating the clothes dryer for a cool down time subsequent to the ADD ON drying time.

13. The method according to claim 12, wherein the calculating of the ADD ON drying time based on the duration of the OFF state is only done in the absence of meaningful moisture data regarding the clothes.

14. The method according to claim 13, wherein meaningful moisture data is determined by the number of wet hits generated by a moisture sensor in the clothes chamber.

15. The method according to claim 12, wherein the calculating of the ADD ON drying time comprises comparing the duration of the OFF state to a predetermined heater OFF time.

16. The method according to claim 15, wherein the predetermined heater OFF time is representative of a user-selected drying cycle parameter.

17. The method according to claim 15, wherein the comparing of the duration of the OFF state to the predetermined heater OFF time comprises determining a ratio of the predetermined heater OFF time to the duration of the OFF state.

18. The method according to claim 17, wherein the calculating of the ADD ON drying time comprises determining a thermal cycle period and then calculating a product of the ratio and the thermal cycle period.

19. The method according to claim 18, wherein the determining of the thermal cycle period comprises determining the lapse of time between sequential heater trip conditions or heater reset conditions.

20. The method according to claim 18, wherein the determining of the duration of the OFF state is determined at the second heater energizing/deenergizing cycle from the heater trip condition to the heater reset condition.

21. The method according to claim 20, wherein the calculating of the drying time comprises determining an accumulated heater OFF time representing the time that the heater is in the OFF state prior to the second heater energizing/deenergizing cycle and subtracting the accumulated heater OFF time from the product.

22. A method of drying clothes in a clothes dryer comprising a clothes chamber for receiving clothes, an air supply system for directing air through the clothes chamber, and a heater for heating the air supplied by the air supply system, the method comprising:

energizing the heater between a lower limit trip point temperature and an upper limit trip point temperature, which is higher than the lower limit trip point temperature, to define an ON state, with the lower limit trip point temperature defining a heater reset condition and the upper limit trip point temperature defining a heater trip condition;

deenergizing the heater between the upper limit trip point temperature and the lower limit trip point temperature to define an OFF state;

cycling the heater between the ON state and the OFF state to supply heat to the clothes chamber;

determining a heater off time by determining a length of time of the heater in the OFF state;

calculating an ADD ON drying time based on the heater off time; and operating the clothes dryer for a cool down time subsequent to the ADD ON drying time.

* * * * *